United States Patent [19]

Armento

[11] 3,964,363

[45] June 22, 1976

[54] HIGH NOTE INTENSIFIER FOR BRASS MUSICAL INSTRUMENTS

[76] Inventor: Anthony F. Armento, 505 Cassingham Road, Fairless Hills, Pa. 19030

[22] Filed: June 30, 1975

[21] Appl. No.: 591,525

[52] U.S. Cl. ..... 84/399

[51] Int. Cl.[2] ..... G10D 9/02

[58] Field of Search ..... 84/387–401, 84/453

[56] References Cited

UNITED STATES PATENTS

| | | | |
|---|---|---|---|
| 578,567 | 3/1897 | Keyes | 84/398 |
| 593,690 | 11/1897 | Richmand | 84/398 X |
| 664,434 | 12/1900 | Richmand | 84/399 X |
| 1,353,297 | 9/1920 | Widmayer | 84/399 |
| 1,441,596 | 1/1923 | Miller | 84/398 |

*Primary Examiner*—Lawrence R. Franklin
*Attorney, Agent, or Firm*—Zachary T. Wobensmith, 2nd; Zachary T. Wobensmith, III

[57] ABSTRACT

An intensifier for high notes is provided for insertion in the mouthpiece and instrument tube of a brass musical instrument, such as a trumpet or a trombone, which comprises a wire with an angularly disposed portion at one end and a freely oscillating enlargement or tongue at the other end for cooperation with the interior of the instrument tube.

4 Claims, 2 Drawing Figures

FIG. 1
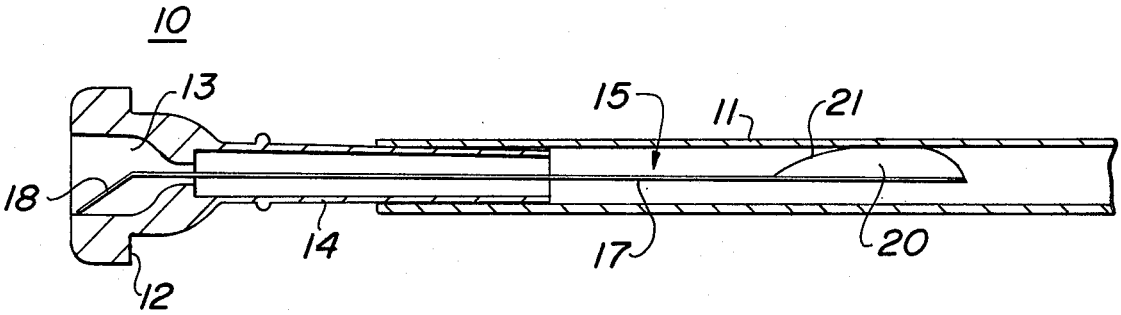
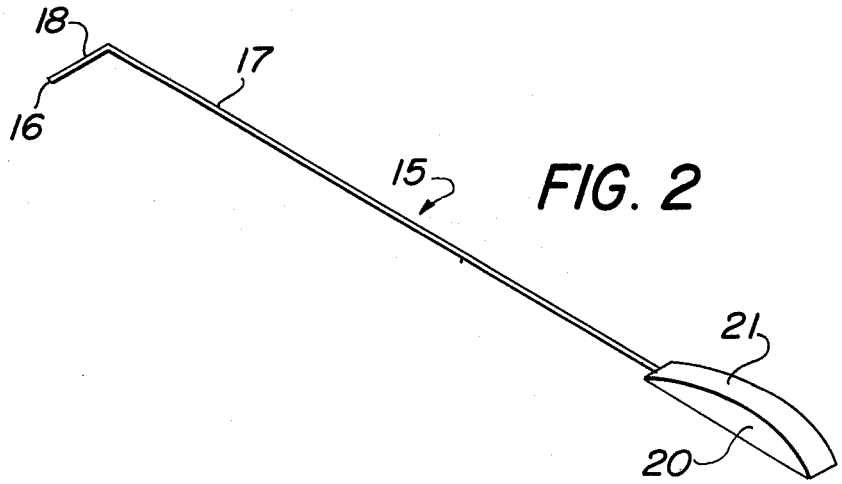
FIG. 2

HIGH NOTE INTENSIFIER FOR BRASS MUSICAL INSTRUMENTS

BACKGROUND OF THE INVENTION

1. Field of the Invention

This invention relates to intensifiers for the high notes of brass musical instruments.

2. Description of the Prior Art

It has heretofore been proposed to provide inserts in the mouthpieces of musical instruments.

Miller in U.S. Pat. No. 1,441,596, shows a mouthpiece for musical instruments in which a thin metallic plate is removably mounted as a partition within a mouthpiece for reduction of the whirling motion of the air to reduce cross-tone vibrations and retain longitudinal tone vibrations, the interest being to enable purity of tone and fine tone qualities to be obtained.

The structure of the Miller patent differs greatly from that of the present disclosure and does not undertake to intensify high notes.

Keyes, in U.S. Pat. No. 578,567, shows a mouthpiece for wind instruments which includes a rigid insert, intended to impart a spiral rotary movement to the column of air forced through the mouthpiece by the user, but not itself intended for oscillation in whole or in part.

Richmand, in U.S. Pat. No. 664,434, shows a cornet in which one or more tongues are placed inside the shank section of the mouthpiece, two tongues set diametrically opposite to each other being preferred. Each tongue has a gradual taper from the broad end to the point which is set in the narrow part of the passageway and at the broad end is secured to the inner tube by a screw and with a coupling including a spiral spring mounting to retain the mouthpiece in a position with the points of the tongue clear of the orifice.

The structure of Richmand's patent and its intended mode of operation bears little resemblance to the structure of the present invention.

SUMMARY OF THE INVENTION

In accordance with the invention an intensifier for high notes is provided for insertion in and removal from the mouthpiece and instrument tube of a brass musical instrument such as a trumpet or trombone which comprises a wire of non-corrosive material, with an angularly disposed portion at one end and a freely oscillating enlargement or tongue at the other end for free oscillatory movement in the instrument tube.

It is the principal object of the invention to provide an intensifier for high notes which is readily mountable in and removable from the mouthpiece and instrument tube of a brass musical instrument.

It is a further object of the invention to provide an intensifier of the character aforesaid which is simple in construction, but effective in its action.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 1 is a longitudinal central sectional view of the mouthpiece and instrument tube of a brass musical instrument having the intensifier of the present invention carried therein, and FIG. 2 is a view in perspective of the intensifier of the present invention removed from the instrument.

It should, of course, be understood that the description and drawings herein are illustrative merely and that various modifications and changes can be made in the structure disclosed without departing from the spirit of the invention.

DESCRIPTION OF THE PREFERRED EMBODIMENT

Referring now more particularly to the drawings a mouthpiece 10 is shown, removably inserted in an instrument tube 11 of a brass musical instrument of the trumpet type, such as a horn, bugle, cornet, trombone, tuba or the like.

The mouthpiece 10 of standard or conventional type, includes a bell shaped mouth portion 12 with an internal air inlet chamber 13 from which a hollow stem portion 14 extends in longitudinal axial alignment. The stem portion 14 extends into the instrument tube 11 in frictional engagement.

The intensifier 15 of the present invention comprises a wire 16 round in cross section and of a length, in a particular embodiment of the order of five and fifteen sixteenth inches.

The wire 16 is preferably of a material free from any tendency to corrosion and can be of copper, bronze, or silver.

The wire 16 has a central portion 17 and an end portion 18 of a length in the specific embodiment of the order of seven sixteenth inches. The end portion 18 is preferably bent at an angle of about 125° with respect to the longitudinal axis of the central portion 17. The other end portion of the wire 16 preferably has secured thereto a tongue or enlargement 20, which may be of metal or plastic, of a length in the specific embodiment of about one and five sixteenth inches, a maximum height of about seven thirty seconds inches and a thickness about the same as the maximum height. The tongue 20 preferably has an outer convex surface 21.

The length of the central portion 17 will be varied for different instruments, a length shorter by seven sixteenths of an inch being suitable for trombones.

The intensifier 15 is insertable for use by separating the mouthpiece 10 from the instrument tube 11, inserting the wire 16 so that the end portion 18 is disposed in the air inlet chamber 13 and inserting the mouthpiece 10 into the instrument tube 11 with the tongue 20 loosely carried in the instrument tube 11. The insertion of the intensifier 15 can be readily effected when intensification of high notes is desired.

With the intensifier 15 in place the tongue 20 is free to oscillate and does not interfere with low and middle range notes. When a high note is played the tongue 20 is held firmly in place by the higher speed and pressure of the air which is compressed in its passage over the surface 21. The change in velocity of the air in passing over the surface 21 by increase of the air column speed diminishes the aerodynamic drag.

The pressure of the air required to produce higher notes without the intensifier 15 to produce higher notes is controlled entirely by the lips of the player. Less lip pressure is required if the intensifier 15 is employed since the air moves more rapidly.

It has been found that by using the intensifier 15 higher tones are easier to obtain and low and normal range notes are not affected as to purity of tone or intonation. The endurance level of the player is also enhanced for the higher notes.

I claim:

1. An intensifier for insertion loosely within the mouthpiece of a brass musical instrument and within an instrument tube carrying the mouthpiece which comprises an elongated wire having a central portion and one end thereof angularly disposed with respect to the central portion for insertion in the mouthpiece, said wire having an enlarged tongue thereon at the other end and freely oscillatable within the instrument tube.

2. An intensifier as defined in claim 1 in which said tongue has an exterior convex face portion.

3. An intensifier as defined in claim 1 in which said angularly disposed end is positioned within an air inlet chamber in the mouthpiece.

4. An intensifier as defined in claim 1 in which said tongue has a width corresponding to its maximum height.

* * * * *